United States Patent [19]

Root et al.

[11] 4,404,994

[45] Sep. 20, 1983

[54] SQUEEZE ROD HOOK

[75] Inventors: Stephen J. Root, Mauldin; Charles F. Kramer, Greenville, both of S.C.

[73] Assignee: Steel Heddle Manufacturing Co., Greenville, S.C.

[21] Appl. No.: 343,052

[22] Filed: Jan. 27, 1982

[51] Int. Cl.[3] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 1,526,159 | 2/1925 | Livermore | 139/92 |
| 4,088,158 | 5/1978 | Kennedy | 139/92 |
| 4,349,052 | 9/1982 | Yaji et al. | 139/92 |

FOREIGN PATENT DOCUMENTS

| | | | |
|---|---|---|---|
| 457382 | 5/1950 | Italy | 139/92 |
| 362994 | 8/1962 | Switzerland | 139/92 |

*Primary Examiner*—Henry Jaudon

*Attorney, Agent, or Firm*—Dority & Flint

[57] ABSTRACT

A rod hook device C, D is illustrated for holding and supporting a heddle rod 18 on a heddle frame 10 which includes a resilient slot B in which the rod is squeezed and held. Slot portion B is carried by a resilient neck A which flexes laterally to align a diagonal opening 40 of slot B in alignment for receiving the heddle rod. Return of neck A to an upright position squeezes rod 18 behind slanted protuberances 42 and 44 which define opening 40.

10 Claims, 9 Drawing Figures

SQUEEZE ROD HOOK

BACKGROUND OF THE INVENTION

The invention relates to a heddle frame for a loom of the type which typically includes a pair of vertically spaced frame slats carried by side frames. Heddle rods are attached at their ends to the side frames and intermediate their ends are supported by various means attached to the frame slats, commonly referred to as rod hooks. Carried on the heddle rods are heddles through which the warp yarn ends are threaded by which the yarn ends are moved up and down during shedding.

Heretofore, various forms of rod hooks have been provided in which rivets are utilized to fasten the heddle rod to the rod hook. U.S. Pat. Nos. 4,252,153, 3,434,505, and 3,470,920 illustrate various forms of rod hooks utilizing rivet connections. Other various forms of rod hooks and attachment means are shown in U.S. Pat. Nos. 4,088,158, 2,877,803, 2,796,083, and 2,117,612. Several of these have attempted to provide attachment by means of which the heddle rod may be quickly released from the rod hook as is desired, such as in threading up of the heddles.

In the case of rivet connections, it has not been possible to completely eliminate the problem of rivet loosening which eventually can lead to attenuated vibrational forces and failure as well as noise.

It has also become an expedient with the advent of high-speed looms and stricter safety and health standards to eliminate as much as possible the wear and noise associated with metal to metal contact. While U.S. Pat. No. 2,117,612 discloses a quickly released rod hook much wear and fretting corrosion exist between the steel heddle rod and steel rod hook during use. The slidable release is difficult to actuate in the space between the heddle rod and frame slat and it is difficult to set the heddle rod parallel with the slat as there is no stop for the stud.

Accordingly, an important object of the present invention is to provide a new and improved rod hook for a heddle frame.

Another important object of the present invention is to provide a simple yet reliable rod hook which can be quickly released in the space available on a heddle frame.

Yet another important object of the present invention is to provide a heddle rod hook having a plastic or non-metal connection to the heddle rod reducing noise and enhancing the useful life of the parts.

SUMMARY OF THE INVENTION

It has been found that a new and improved heddle rod hook can be had according to the invention by providing a main rod hook body portion adapted for connection to a frame slat of a heddle frame which carries a pivotable resilient neck portion in which a slot is formed having an opening which aligns with the heddle rod when pivoted laterally and which squeezes and holds the rod when pivoted back to an upright support position.

BRIEF DESCRIPTION OF THE DRAWIMG

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is an elevation illustrating a portion of a heddle frame incorporating heddle rod hooks constructed according to the present invention, FIG. 2 is a perspective view of a heddle rod hook constructed according to the present invention, FIG. 3 is an enlarged view of a flexible neck and slot constructed according to the presnt invention squeezing and holding a heddle rod, FIG. 4 is an elevation illustrating the flexible neck and slot of a heddle rod hook constructed accoording to the present invention when pivoted to a receiving position in which the heddle rod is received in the slot, FIG. 5 is a sectional view taken along line 5—5 of FIG. 3, FIG. 6 is an elevation illustrating one form of a main body portion of a rod hook constructed according to the present invention as attached to a frame slat, FIG. 6A is an end view of FIG. 6, FIG. 7 is an elevation illustrating a rod hook constructed according to the present invention having an alternate form of a main body attachment portion, and FIG. 7A is an end view of FIG. 7.

DESCRIPTION OF A PREFERRED EMBODIMENT

The invention relates to a heddle frame for a loom and in particular to a rod hook for supporting a heddle rod on the frame. Since heddle frames are conventional and well known in the art, as well as their application to weaving and to a loom, only so much of a heddle frame and loom as are necessary to an understanding of the invention are illustrated. Accordingly, the drawings illustrate a heddle frame at 10 as including a pair of vertically spaced frame slats 12 and 14 which are secured together by side frame members 16.

Figure 1:
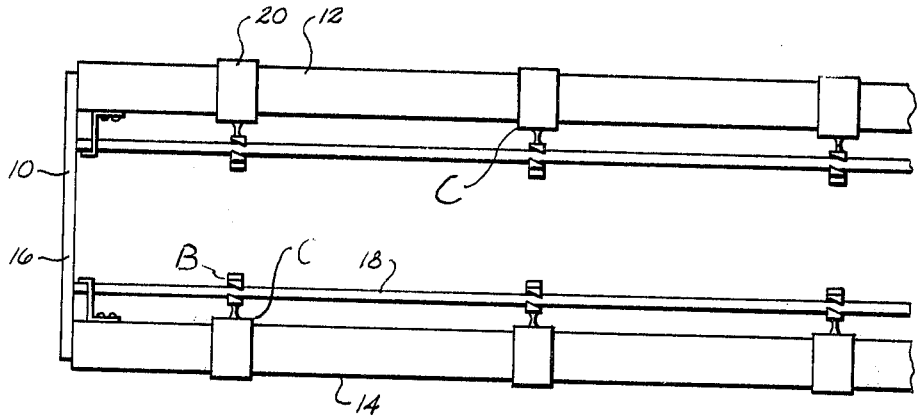
Figure 2:
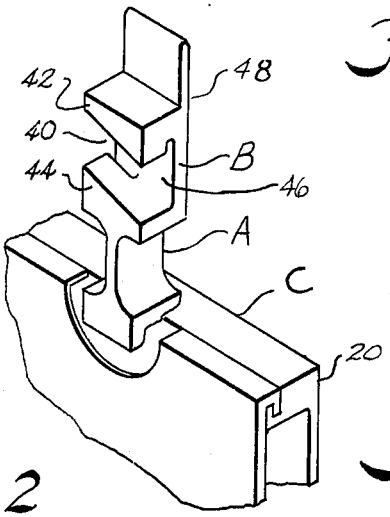
Figure 5:
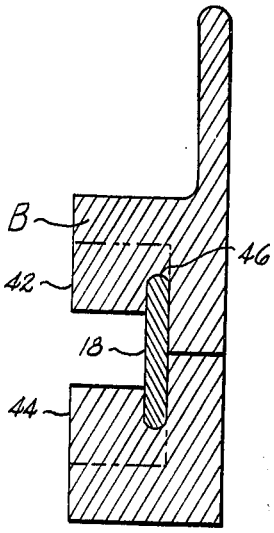
Figure 3:
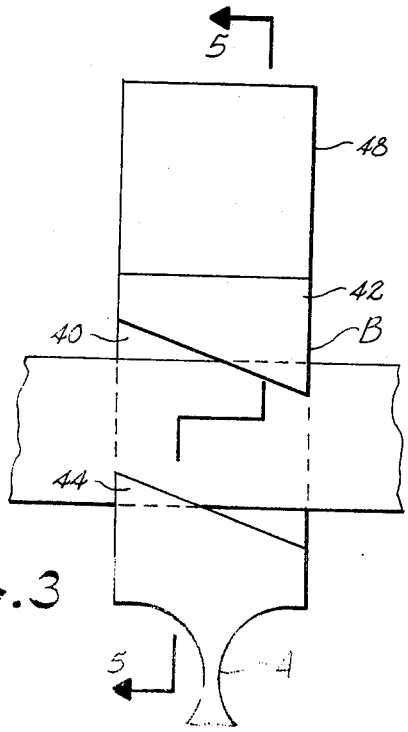
Figure 4:
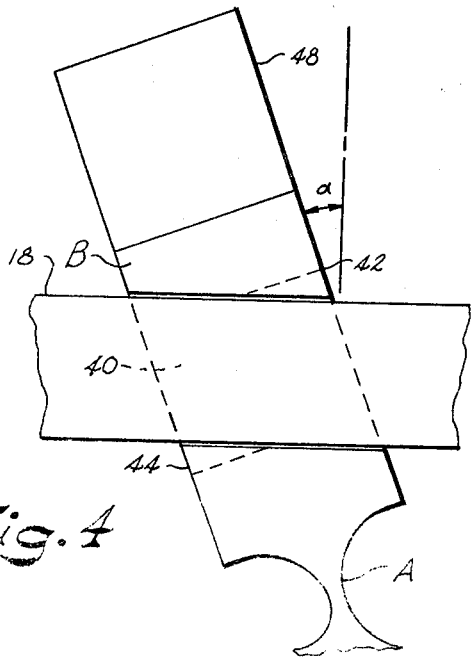

According to the invention, rod hooks are carried on the frame slats which include a main body portion for attaching the rod hook to the heddle frame and a flexible resilient neck means A carried by the main body portion. Slot means B carried by the neck means receives the heddle rod 18 squeezing and holding the heddle rod firmly in a support position. In the support position, the neck means A is generally upright and unflexed, as best seen in FIG. 3. Slot means B aligns to receive the heddle rod 18 when neck means A is flexed to a receiving position, as best seen in FIG. 4. The slot means is then flexed back to the upright position where it grips and squeezes the heddle rod.

Figure 7:
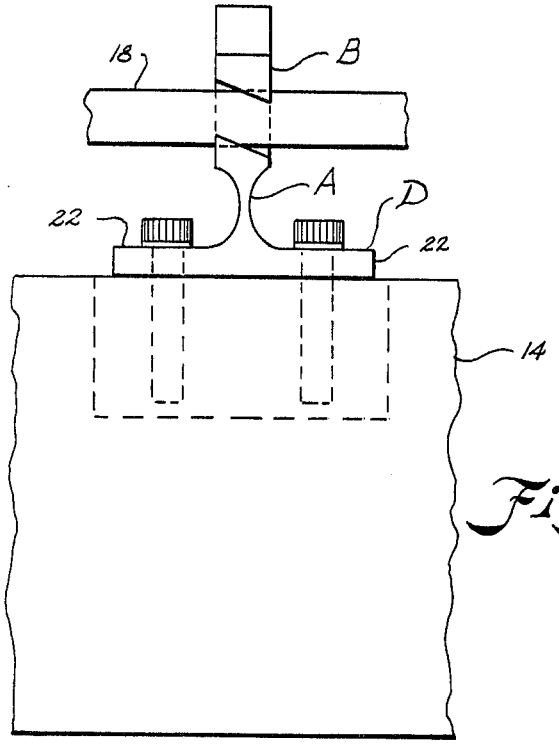
Figure 7A:
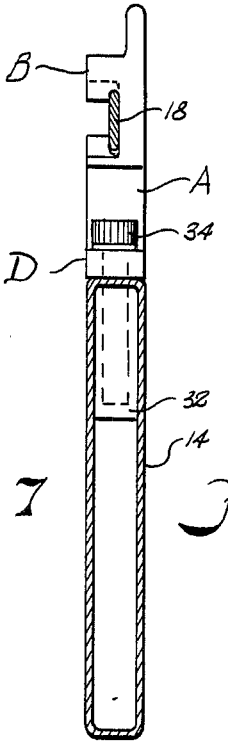
Figure 6:
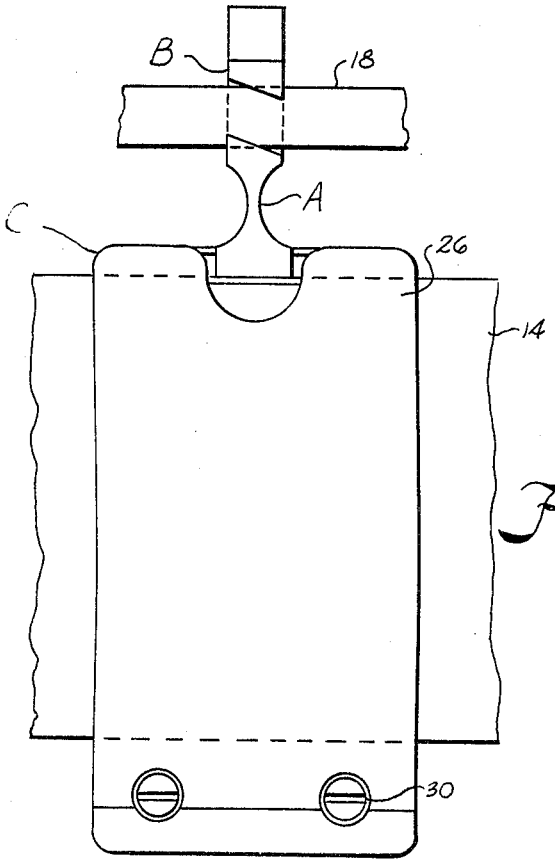
Figure 6A:
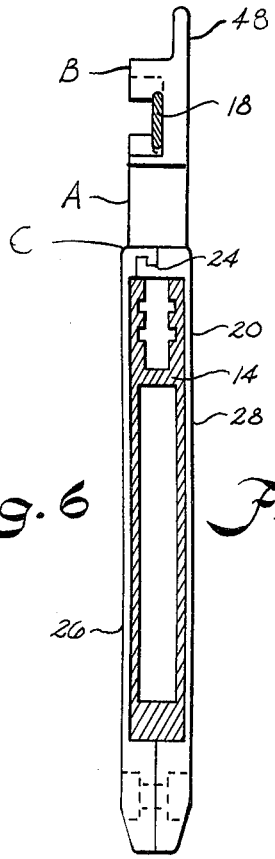

Referring now in more detail to the drawings, a rod hook device C includes a main body portion 20 which carries the neck portion A of the rod hook which, in turn, carries the resilient slot means B. The main body portion 20 which attaches the rod hook to the frame slats 12 and 14 of the heddle frame is illustrated in two alternate forms. In FIG. 6, body portion 20 is shown in the form of a snap fitting of a suitable plastic material which includes a snap connection 24. The snap fitting 20 includes a hollow opening in which the frame slat 14 slides or the snap may be placed over the frame slat in an unsnapped condition and then snapped in place. The snap fitting is sufficiently resilient that a side 26 may be spread apart from side 28 to be placed over the frame slat. The bottom is held together by a suitable molded snap connection 30 or by any other suitable means. This provides a design which may be used by new or existing frames to simplify the assembly and provide a snap-together part which can be more easily attached or removed from the slat. In FIG. 7, an alternate form of the main body attachment portion is shown at 22 in the form of a flange which attaches to a threaded insert block 32 inserted within the frame slat 14 by means of screws 34. The bolted configuration may be used in existing frames containing a threaded insert block.

Referring now to FIGS. 3 and 4, slot means B is illustrated as including a diagonal opening 40 defined by an upper protuberance 42 and a lower protuberance 44, each having an inclination or slant of approximately twenty degrees. Behind the protuberances is an enlarged slot opening 46 in which the heddle rod 18 is received and held thereby. The slot means B is preferably constructed of a resilient plastic material having suitable squeezing and gripping power so as to squeeze the rod firmly in the slot 40 behind the protuberances.

With the slot means B pivoted or flexed approximately twenty degrees as indicated by the angle, a, of FIG. 4, the slot opening 40 is in generally parallel alignment with the heddle rod 18. In this position, the heddle rod 18 may be received in the slot and return of the slot means B back to an upright position, as best seen in FIG. 3, squeezes the rod 18 behind the protuberances 42 and 44. Slot 46 corresponds generally to the height of heddle rod 18 so that there is little or no play in the vertical direction between the slot and rod.

In practice, it is preferred that the main body 22, 24, neck A and slot means B are molded of one-piece thermo-plastic material such as nylon. The neck means A has a reduced configuration relative to the width of the slot means B to allow lateral flexing.

Thus, it can be seen that a highly advantageous construction for a rod hook can be had according to the invention in which the steel heddle rod 18 is resiliently and positively gripped and squeezed in slot 46 and supported on the heddle frame with reduced wear and noise. The heddle rod hook may be released quickly merely by lateral flexing of neck portion A and slot means B under finger pressure at 48 in the adding or threading of the heddles.

While a preferred embodiment of the invention has been described using specific terms, such description is for illustrative purposes only, and it is to be understood that changes and variations may be made without departing from the spirit or scope of the following claims.

What is claimed is:

1. A heddle rod support device for supporting a heddle rod on an associated heddle frame of a weaving loom comprising:

a main body portion adapted for attachment to said heddle frame;

flexible neck means carried by said main body portion;

resilient slot means carried by said neck means squeezing and holding said heddle rod firmly in a support position when said neck means is generally upright; and said slot means having a receiving position when said neck means is flexed wherein said slot means is open for receiving said heddle rod and thereafter returnable to said support position.

2. The device of claim 1 wherein said slot means includes a diagonal opening which opens generally parallel to said heddle rod when said neck means is flexed for receiving said heddle rod.

3. The device of claim 2 wherein said slot means includes upper and lower protuberances defining said diagonal opening, said heddle rod being held behind said protuberances when supported by said device.

4. The device of claim 1 wherein said main body, neck means, and slot means are molded as one piece.

5. The device of claim 4 wherein said device is molded from a thermoplastic material.

6. The device of claim 1 wherein said neck means is reduced in its lateral with relative to said slot means and flexes laterally.

7. In a heddle frame for a loom of the type which includes a pair of spaced frame slats, a plurality of heddle rod support devices carried on said slats for supporting heddle rods on which heddles are carried, the improvement in said heddle rod support device which comprises:

pivotable slot means receiving said heddle rod having a support position in which said heddle rod is squeezed and supported therein; and said slot means pivoting to an open position in which said heddle rod is freely received therein without squeezing and being returnable thereafter in pivotal movement to said support position.

8. The device of claim 7 in which said slot means includes an upper protuberance and a lower protuberance forming a diagonal opening in said slot means.

9. The device of claim 8 in which an enlarged slot exists behind said protuberances in which said heddle rod is supported and squeezed behind said protuberances.

10. The device of claim 7 further comprising means attaching said slot means to said frame slats including flexible neck means by which said slot means pivots.

* * * * *